US011761442B2

(12) United States Patent
Lee et al.

(10) Patent No.: US 11,761,442 B2
(45) Date of Patent: Sep. 19, 2023

(54) SCROLL COMPRESSOR

(71) Applicant: Hanon Systems, Daejeon (KR)

(72) Inventors: Kyung Jae Lee, Daejeon (KR); Jeong Ki Seo, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 219 days.

(21) Appl. No.: 17/424,540

(22) PCT Filed: Jan. 17, 2020

(86) PCT No.: PCT/KR2020/000846

§ 371 (c)(1),
(2) Date: Jul. 21, 2021

(87) PCT Pub. No.: WO2020/153665

PCT Pub. Date: Jul. 30, 2020

(65) Prior Publication Data

US 2022/0120272 A1 Apr. 21, 2022

(30) Foreign Application Priority Data

Jan. 21, 2019 (KR) ..... 10-2019-0007315

(51) Int. Cl.
*F04C 2/02* (2006.01)
*F04C 18/02* (2006.01)
(Continued)

(52) U.S. Cl.
CPC ..... *F04C 2/025* (2013.01); *F04C 15/0003* (2013.01); *F04C 18/02* (2013.01);
(Continued)

(58) Field of Classification Search
CPC .... F04C 2/025; F04C 15/0003; F04C 23/008; F04C 18/02; F04C 18/0207; F04C 18/0246; F04C 18/0253; F01C 1/0253
See application file for complete search history.

(56) References Cited

FOREIGN PATENT DOCUMENTS

CN 109072908 A 12/2018
EP 2500570 A2 * 9/2012 ..... F01C 1/0215
(Continued)

OTHER PUBLICATIONS

English translation of EP-2500570 by PE2E Mar. 30, 2023.*
English translation of WO-201516028 by PE2E Mar. 30, 2023.*
English translation of EP 3933198 by PE2E Jul. 19, 23.*

*Primary Examiner* — Deming Wan
(74) *Attorney, Agent, or Firm* — Shumaker, Loop & Kendrick, LLP; James D. Miller

(57) ABSTRACT

A scroll compressor including a casing; an orbiting scroll orbitingly moved inside the casing; a fixed scroll engaged with the orbiting scroll to form a pair of compression chambers; and a main frame supporting the orbiting scroll, wherein the fixed scroll includes a fixed scroll base plate and a fixed scroll wrap protruding from the fixed scroll base plate, wherein the main frame includes a main frame base plate provided on an opposite side of the fixed scroll base plate with respect to the orbiting scroll, and wherein the fixed scroll base plate, the main frame base plate and the casing may form an orbiting space of the orbiting scroll. An orbiting radius of the orbiting scroll is increased inside the casing having a predetermined size, so a refrigerant discharge amount is increased in a state in which the orbiting scroll and the fixed scroll are accommodated inside the casing.

12 Claims, 10 Drawing Sheets

(51) Int. Cl.
*F04C 15/00* (2006.01)
*F04C 23/00* (2006.01)

(52) U.S. Cl.
CPC ..... *F04C 18/0207* (2013.01); *F04C 18/0246* (2013.01); *F04C 18/0253* (2013.01); *F04C 2240/30* (2013.01); *F04C 2240/40* (2013.01)

(56) References Cited

FOREIGN PATENT DOCUMENTS

| | | | | |
|---|---|---|---|---|
| EP | 3933198 | A1 * | 1/2022 | |
| JP | S63129182 | A | 6/1988 | |
| JP | H02196180 | A | 8/1990 | |
| JP | H04153589 | A | 5/1992 | |
| JP | H0723714 | B2 | 3/1995 | |
| JP | H07151073 | A | 6/1995 | |
| JP | 2004324564 | A | 11/2004 | |
| JP | 4022166 | B2 | 12/2007 | |
| KR | 920007282 | B1 | 8/1992 | |
| KR | 20110058660 | A | 6/2011 | |
| KR | 101860355 | B1 | 5/2018 | |
| WO | WO-2015016028 | A1 * | 2/2015 | ..... F01C 1/0215 |

* cited by examiner

SCROLL COMPRESSOR

CROSS-REFERENCE TO RELATED PATENT APPLICATIONS

This patent application is a United States national phase patent application based on PCT/KR2020/000846 filed on Jan. 17, 2020, which claims the benefit of Korean Patent Application No. KR 10-2019-0007315 filed on Jan. 21, 2019, the entire contents of both of which are hereby incorporated herein by reference.

TECHNICAL FIELD

The present disclosure relates to a scroll compressor, and more particularly, to a scroll compressor capable of compressing a refrigerant with a fixed scroll and an orbiting scroll.

BACKGROUND ART

In general, an air conditioning device (A/C) for heating and cooling an interior is installed in a vehicle. The air conditioning device is a component of a cooling system, and includes a compressor compressing a low-temperature and low-pressure gaseous refrigerant introduced from an evaporator into a high-temperature and high-pressure gaseous refrigerant and sending it to a condenser.

The compressor includes a reciprocating type compressing a refrigerant through a reciprocating motion of a piston, and a rotary type performing compression while rotating. According to a power transmission method, the reciprocating type includes a crank type transmitting power to a plurality of pistons using a crank, a swash plate type transmitting power to a rotating shaft on which a swash plate installed, and the like, and wherein the rotary type includes a vane rotary type using a rotating rotary shaft and vanes, and a scroll type using orbiting scroll and fixed scroll.

A scroll compressor is widely used for refrigerant compression in air conditioning devices due to its advantages of obtaining a relatively high compression ratio compared to other types of compressors and obtaining a stable torque through smooth refrigerant suction, compression and discharge strokes.

FIG. 1 is a cross-sectional view showing a conventional scroll compressor.

Referring to FIG. 1, the conventional scroll compressor includes a housing 10, a motor 20 generating a rotational force inside the housing 10, a rotating shaft 30 rotated by the motor 20, an orbiting scroll 50 rotated by the rotating shaft 30, and a fixed scroll 60 engaged with the orbiting scroll 50 to form a pair of compression chambers C.

The housing 10 includes a center housing 12, a front housing 14 coupled to the center housing 12 to form a first space S1 in which the motor 20 is accommodated, and a rear housing 16 coupled to the center housing 12 from an opposite side of the front housing 14 based on a center housing base plate 12*a* to be described later to form a second space S2 in which the orbiting scroll 50 and the fixed scroll 60 are accommodated.

The center housing 12 includes a center housing base plate 12*a* supporting the orbiting scroll 50 and a center housing side plate 12*b* protruding from an outer periphery of the center housing base plate 12*a* toward the front housing 14.

A central portion of the center housing base plate 12*a* is penetrated by one end of the rotating shaft 30.

The front housing 14 includes a front housing base plate 14*a* facing the center housing base plate 12*a* and supporting the other end of the rotating shaft 30, and a front housing side plate 14*b* protruding from an outer periphery of the front housing base plate 14*a* and fastened to the center housing side plate 12*b* and supporting the motor 20.

Here, the center housing base plate 12*a*, the center housing side plate 12*b*, the front housing base plate 14*a* and the front housing side plate 14*b* form the first space S1, wherein the center housing 12 and the front housing 14 are separately formed and then fastened to each other to enable the motor 20 to be inserted into the first space S1. At this time, since leakage may occur between the center housing 12 and the front housing 14, a first sealing member 70 sealing the first space S1 from the outside of the housing 10 is interposed between the front housing side plate 14*b* and the center housing side plate 12*b*.

The rear housing 16 includes a rear housing base plate 16*a* opposite to the center housing base plate 12*a* and a rear housing side plate 16*b* protruding from an outer periphery of the rear housing base plate 16*a* and fastened to the outer periphery of the center housing base plate 12*a*.

In addition, the rear housing 16 further includes a discharge chamber D accommodating a refrigerant discharged from the compression chamber C.

Here, the center housing base plate 12*a*, the rear housing base plate 16*a* and the rear housing side plate 16*b* form the second space S2, wherein the center housing 12 and the rear housing 16 are separately formed and then fastened to each other to enable the orbiting scroll 50 and the fixed scroll 60 to be inserted into the second space S2. At this time, since leakage may occur between the center housing 12 and the rear housing 16, a second sealing member 80 sealing the second space S2 from the outside of the housing 10 is interposed between the center housing base plate 12*a* and the rear housing side plate 16*b*.

The motor 20 includes a stator fixed to the front housing side plate 14*b* and a rotor rotating inside the stator in interaction with the stator.

The rotating shaft 30 is fastened to the rotor and passes through a central portion of the rotor, and one end of the rotating shaft 30 passes through the center housing base plate 12*a* and is engaged with an eccentric bush 40 for rotating the orbiting scroll 50, and the other end of the rotating shaft 30 is supported on the front housing base plate 14*a*.

The orbiting scroll 50 includes an orbiting scroll base plate 52 formed in a disk shape, an orbiting scroll wrap 54 protruding from a central portion of the orbiting scroll base plate 52 toward the fixed scroll 60, and an orbiting scroll boss 530 protruding from the orbiting scroll base plate 52 to the opposite side of the orbiting scroll wrap 54 and engaged with the eccentric bush 40.

The fixed scroll 60 includes a fixed scroll base plate 62 formed in a disk shape, a fixed scroll wrap 64 protruding from a central portion of the fixed scroll base plate 62 and engaged with the orbiting scroll wrap 54, and a fixed scroll side plate 66 protruding from an outer periphery of the fixed scroll base plate 62 and fastened to the center housing base plate 12*a*.

Here, the orbiting scroll 50 and the fixed scroll 60 are accommodated in the housing 10 so that a noise generated in the compression chamber C is prevented from radiating to the outside of the housing 10, the center housing base plate 12*a*, the fixed scroll base plate 62 and the fixed scroll side plate 66 form an orbiting space of the orbiting scroll 50, and the fixed scroll side plate 66 is interposed between the rear housing side plate 16*b* and the orbiting scroll 50.

However, the conventional scroll compressor has difficulty in increasing a refrigerant discharge amount in a state in which the orbiting scroll 50 and the fixed scroll 60 are accommodated inside the housing 10. Specifically, in order to increase the refrigerant discharge amount, an orbiting radius of the orbiting scroll 50 must be increased or an axial height of the compression chamber C must be increased. However, since the fixed scroll side plate 66 is formed between the rear housing side plate 16*b* and the orbiting scroll 50, it is difficult to increase the orbiting radius of the orbiting scroll 50 inside the housing 10 having a predetermined size. In particular, as the fixed scroll side plate 66 includes a fastening hole (not illustrated) through which a fastening member (not illustrated) for fastening the fixed scroll 60 to the center housing base plate 12*a* passes, and as it is formed thicker than the rear housing side plate 16*b* to prevent a decrease in rigidity of the fixed scroll side plate 66 due to the fastening hole (not illustrated), it is more difficult to increase the orbiting radius of the orbiting scroll 50. In addition, since the durability of the orbiting scroll 50 and the fixed scroll 60 is significantly reduced when a distance between the orbiting scroll base plate 52 and the fixed scroll base plate 62 is increased and a height of the orbiting scroll wrap 54 and a height of the fixed scroll wrap 64 are increased, it is also difficult to increase the axial height of the compression chamber C.

DISCLOSURE OF INVENTION

Accordingly, an object of the present disclosure is to provide a scroll compressor capable of increasing a refrigerant discharge amount while an orbiting scroll and a fixed scroll are accommodated in a casing.

In order to achieve the object as described above, the present disclosure provides a scroll compressor including a casing; a motor generating a rotational force inside the casing; a rotating shaft rotated by the motor; an orbiting scroll orbitingly moved by the rotating shaft; a fixed scroll engaged with the orbiting scroll to form a pair of compression chambers; and a main frame supporting the orbiting scroll, wherein the fixed scroll includes a fixed scroll base plate and a fixed scroll wrap protruding from the fixed scroll base plate, wherein the main frame includes a main frame base plate provided on an opposite side of the fixed scroll base plate with respect to the orbiting scroll, and wherein the fixed scroll base plate, the main frame base plate and the casing form an orbiting space of the orbiting scroll.

The fixed scroll wrap may opposite to the casing.

The fixed scroll may further include a fixed scroll flange radially protruding from an outer circumferential surface of the fixed scroll base plate and fastened to the casing.

The main frame may further include a main frame flange radially protruding from an outer circumferential surface of the main frame base plate and fastened to the casing.

The casing may include a first casing having an accommodation space in which the motor, the rotating shaft, the orbiting scroll, the fixed scroll and the main frame are accommodated; and a second casing fastened to the first casing and covering the accommodation space.

The first casing may include a first casing base plate supporting one end of the rotating shaft; and a first casing side plate protruding from an outer periphery of the first casing base plate toward the second casing and supporting the motor, the main frame and the fixed scroll.

The first casing side plate may include a first flange insertion groove into which the main frame flange is inserted; and a second flange insertion groove into which the fixed scroll flange is inserted.

The first flange insertion groove may include a first flange insertion groove base surface bent from an inner circumferential surface of the first casing side plate; and a first flange insertion groove inner circumferential surface bent from the first flange insertion groove base surface and extending to an end surface of the first casing side plate.

The main frame flange may include a main frame flange base surface in contact with the first flange insertion groove base surface; a main frame flange outer circumferential surface bent from the main frame flange base surface and opposite to the first flange insertion groove inner circumferential surface; and a main frame flange upper surface bent from the main frame flange outer circumferential surface and forming a rear surface of the main frame flange base surface.

The main frame flange may include a first fastening hole passing through the main frame flange from the main frame flange upper surface to the main frame flange base surface, and the first flange insertion groove may include a second fastening hole formed to be concave from the first flange insertion groove base surface, and the main frame flange may be fastened to the first casing side plate by a first fastening member inserted into the first fastening hole and the second fastening hole.

The second flange insertion groove may include a second flange insertion groove base surface bent from an inner circumferential surface of the first casing side plate; and a second flange insertion groove inner circumferential surface bent from the second flange insertion groove base surface and extending to an end surface of the first casing side plate.

The fixed scroll flange may include a fixed scroll flange base surface in contact with the second flange insertion groove base surface; a fixed scroll flange outer circumferential surface bent from the fixed scroll flange base surface and facing the second flange insertion groove inner circumferential surface; and a fixed scroll flange upper surface bent from the fixed scroll flange outer circumferential surface and forming a rear surface of the fixed scroll flange base surface.

The fixed scroll flange may include a third fastening hole penetrating the fixed scroll flange from the fixed scroll flange upper surface to the fixed scroll flange base surface, and the second flange insertion groove may include a fourth fastening hole formed to be concave from the second flange insertion groove base surface, and the fixed scroll flange may be fastened to the first casing side plate by a second fastening member inserted into the third fastening hole and the fourth fastening hole.

The motor, the rotating shaft, the orbiting scroll, the fixed scroll, and the main frame may be inserted from the second casing toward the first casing and accommodated in the accommodation space.

A sealing member sealing the accommodation space from the outside of the casing may be formed between the first casing and the second casing, and the accommodation space may be sealed only by the sealing member.

A scroll compressor according to the present disclosure includes a casing; a motor generating a rotational force inside the casing; a rotating shaft rotated by the motor; an orbiting scroll orbitingly moved by the rotating shaft; a fixed scroll engaged with the orbiting scroll to form a pair of compression chambers; and a main frame supporting the orbiting scroll, wherein the fixed scroll includes a fixed scroll base plate and a fixed scroll wrap protruding from the fixed scroll base plate, wherein the main frame includes a main frame base plate provided on an opposite side of the fixed scroll base plate with respect to the orbiting scroll, and wherein the fixed scroll base plate, the main frame base plate and the casing form an orbiting space of the orbiting scroll, so that may increase an orbiting radius of the orbiting scroll is increased inside the casing having a predetermined size, thereby increasing a refrigerant discharge amount while the orbiting scroll and the fixed scroll are accommodated in the casing.

DESCRIPTION OF EMBODIMENTS OF THE INVENTION

Hereinafter, a scroll compressor according to the present disclosure will be described in detail with reference to the accompanying drawings.

Figure 1:
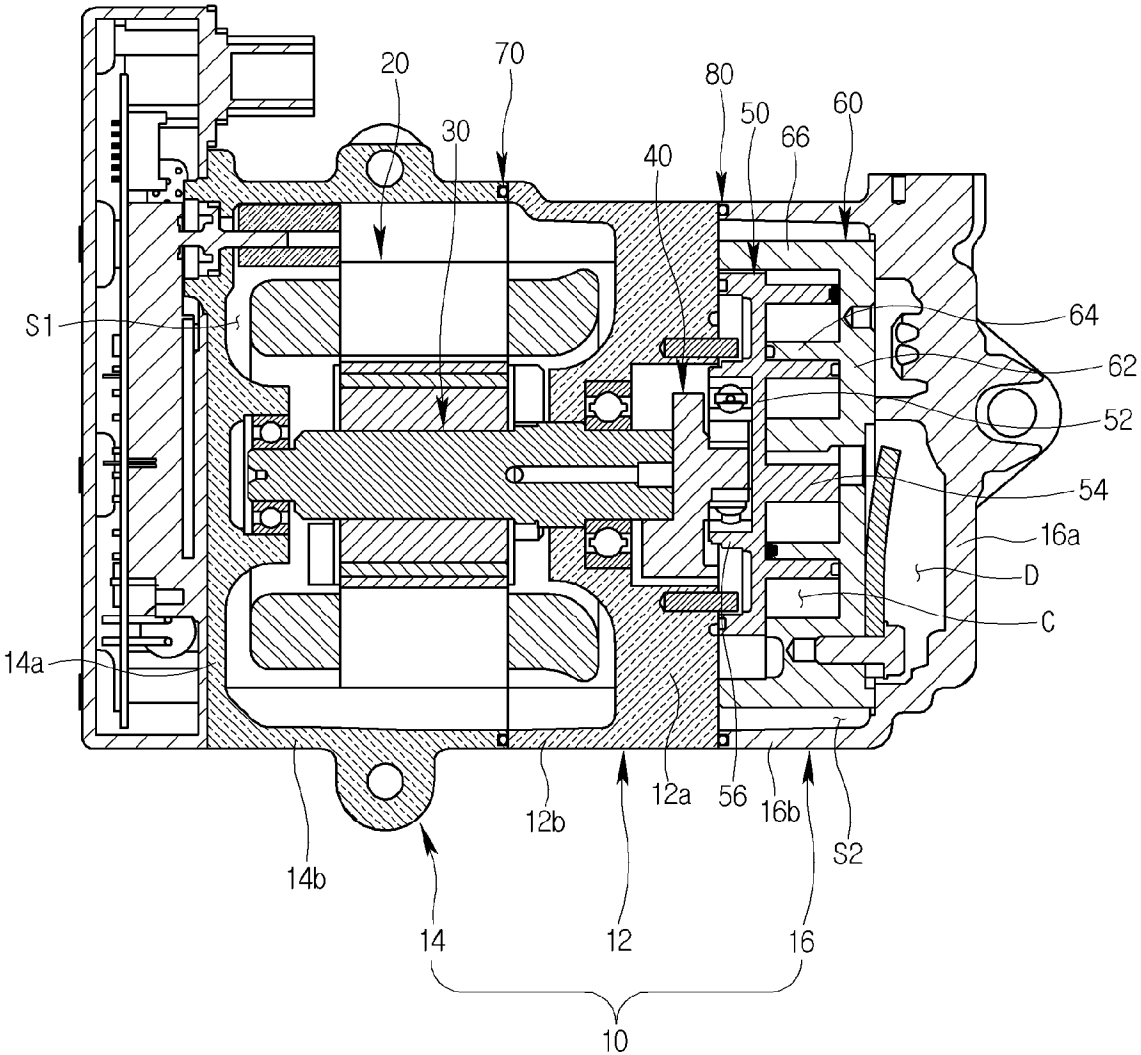
FIG. 1 is a cross-sectional view showing a conventional scroll compressor.
Figure 2:
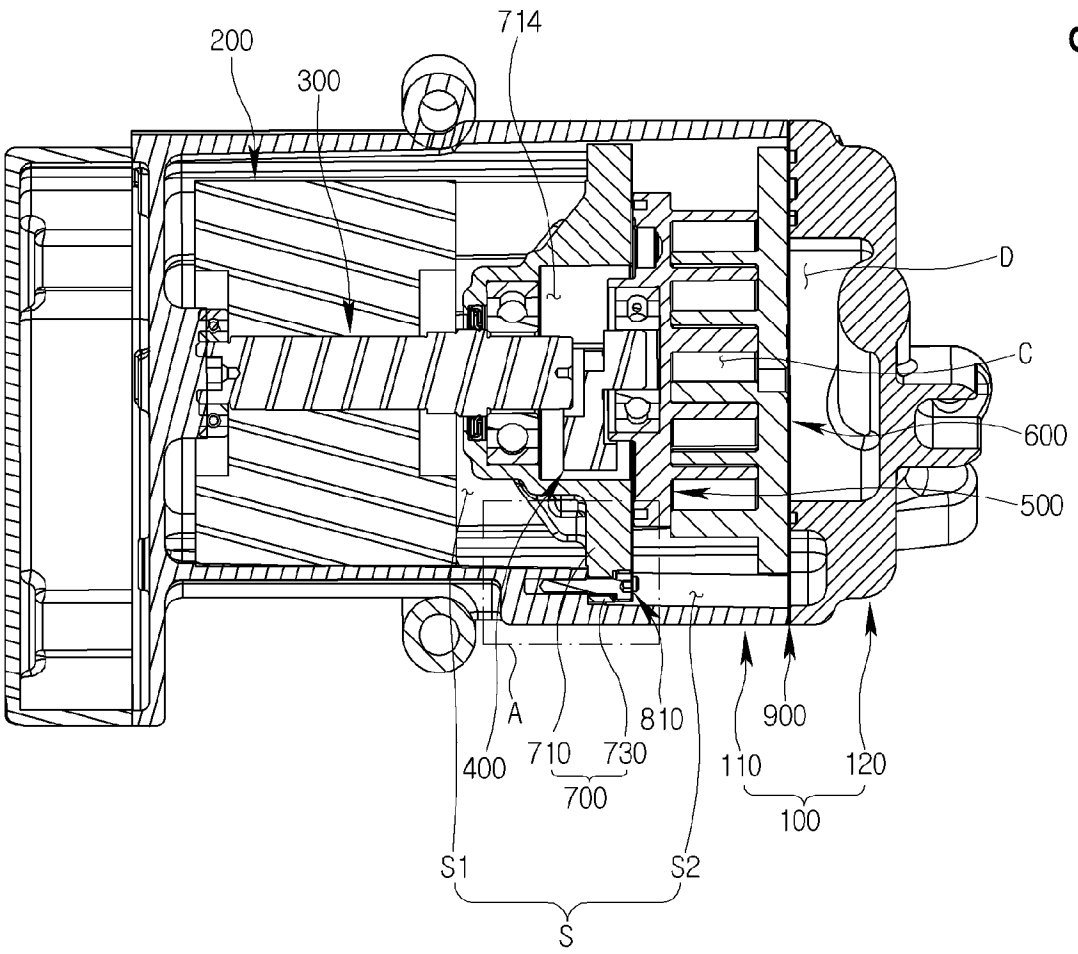
FIG. 2 is a cross-sectional view showing a scroll compressor according to an embodiment of the present disclosure.
Figure 3:
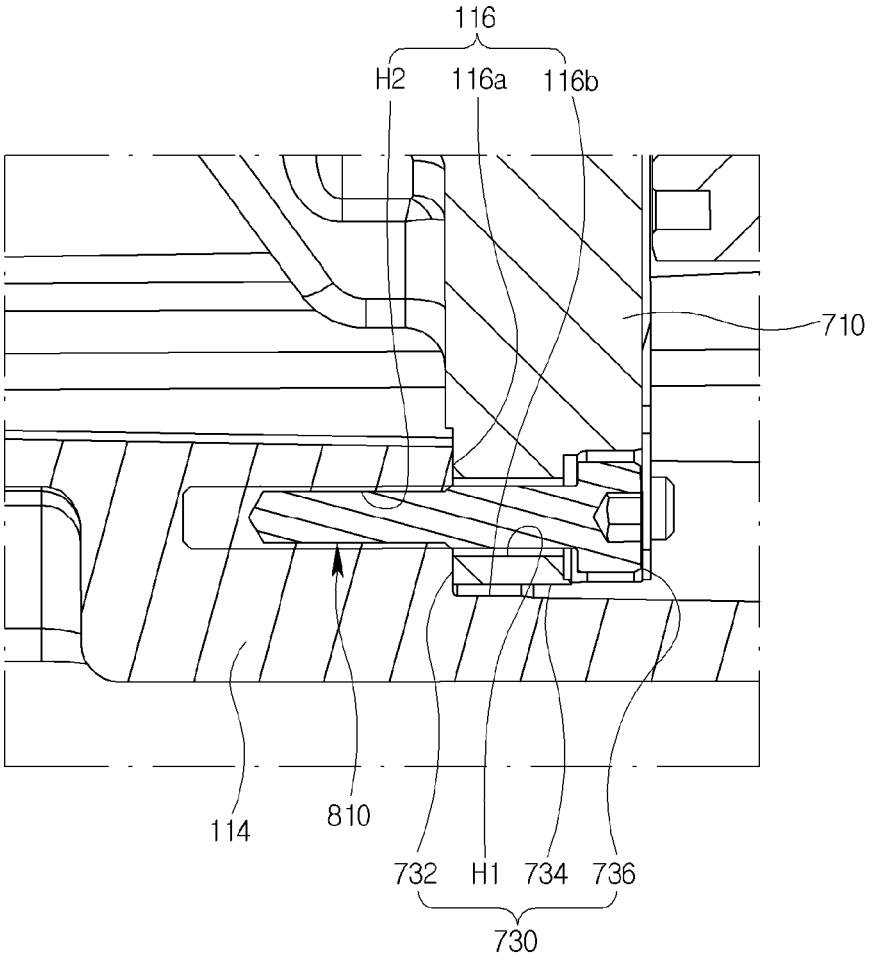
FIG. 3 is an enlarged view of part A of FIG. 2.
Figure 4:
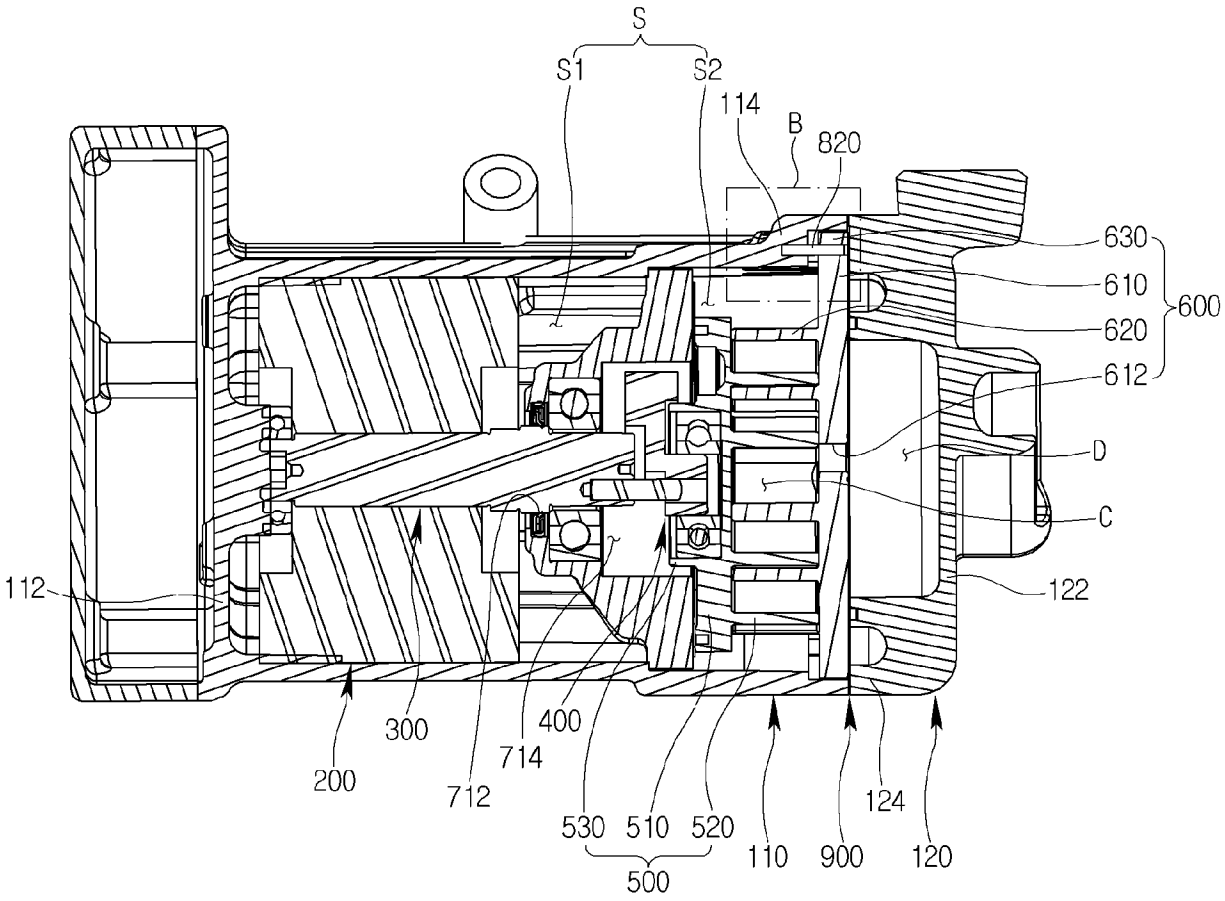
FIG. 4 is a cross-sectional view showing the scroll compressor of FIG. 2 in a different direction.
Figure 5:
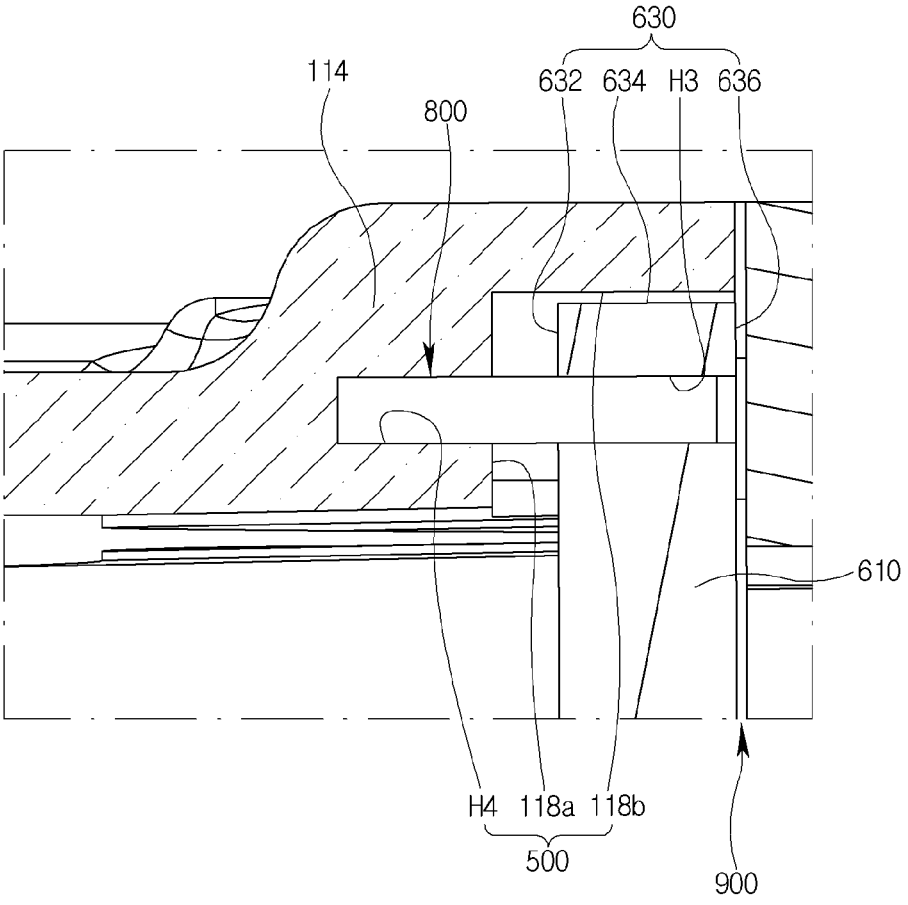
FIG. 5 is an enlarged view of part B of FIG. 4.
Figure 6:
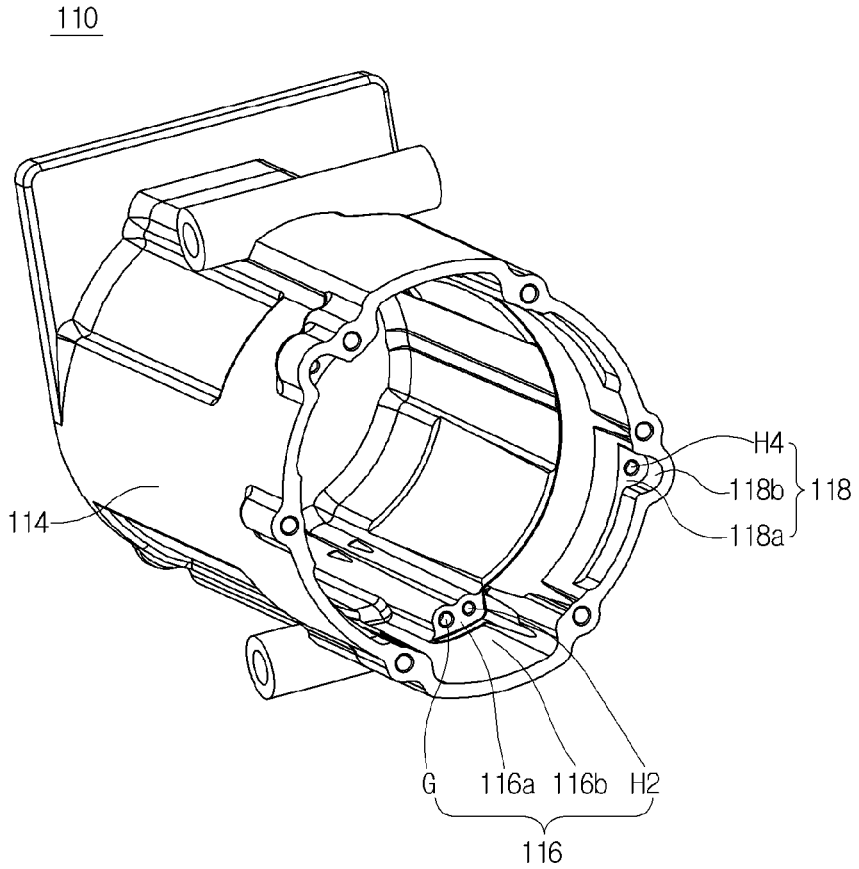
FIG. 6 is a perspective view showing a first casing in the scroll compressor of FIG. 2.
Figure 7:
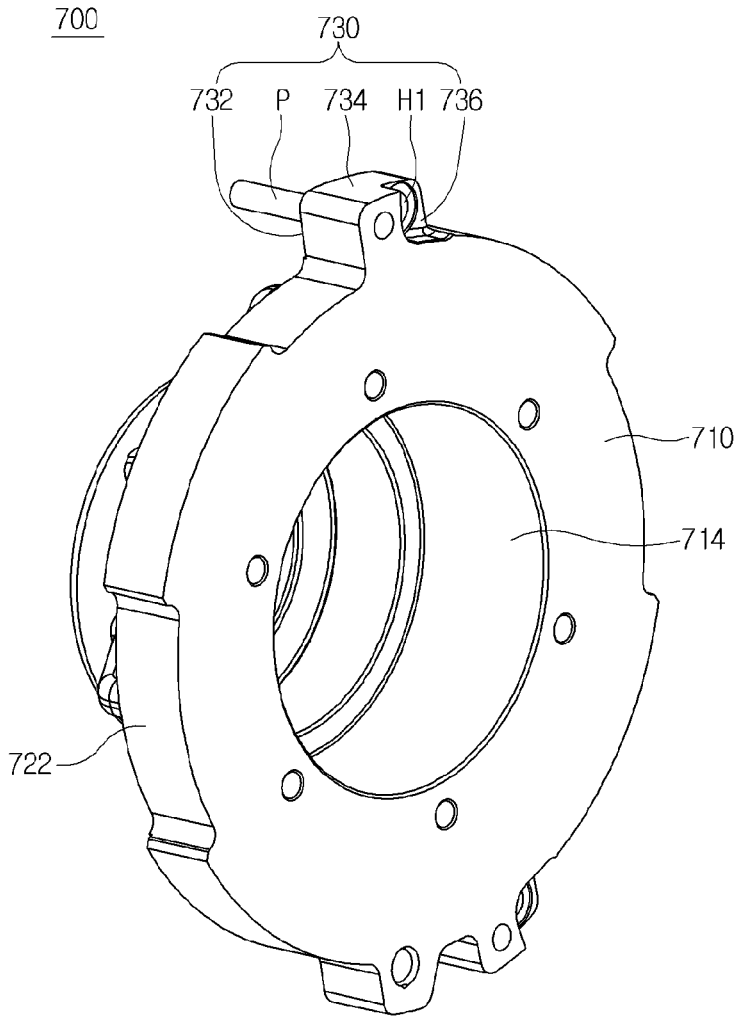
FIG. 7 is a perspective view showing a main frame in the scroll compressor of FIG. 2.
Figure 8:
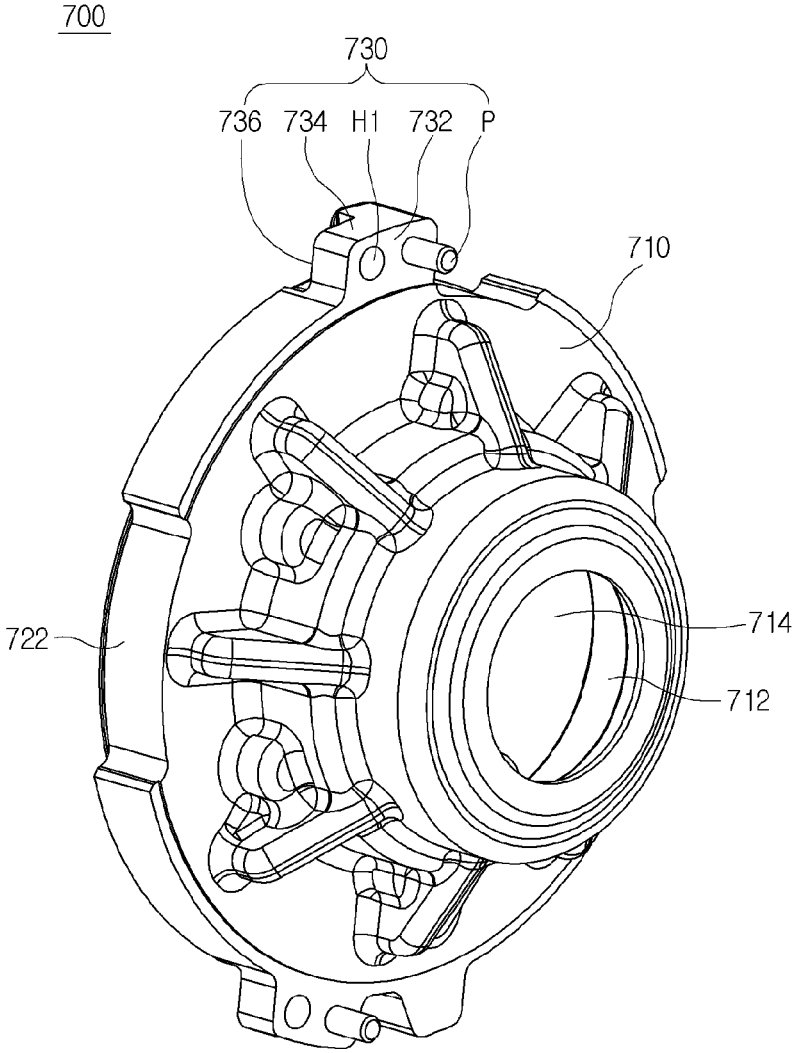
FIG. 8 is a perspective view showing a rear surface of FIG. 7.
Figure 9:
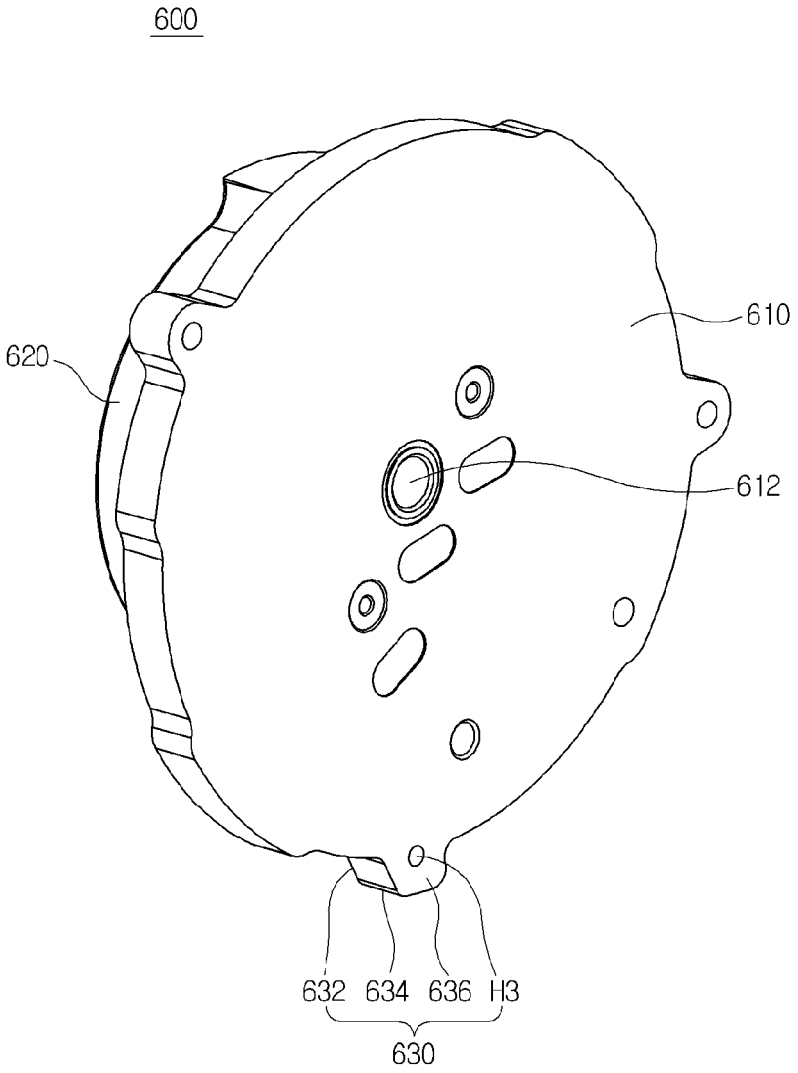
FIG. 9 is a perspective view showing a fixed scroll in the scroll compressor of FIG. 2.
Figure 10:
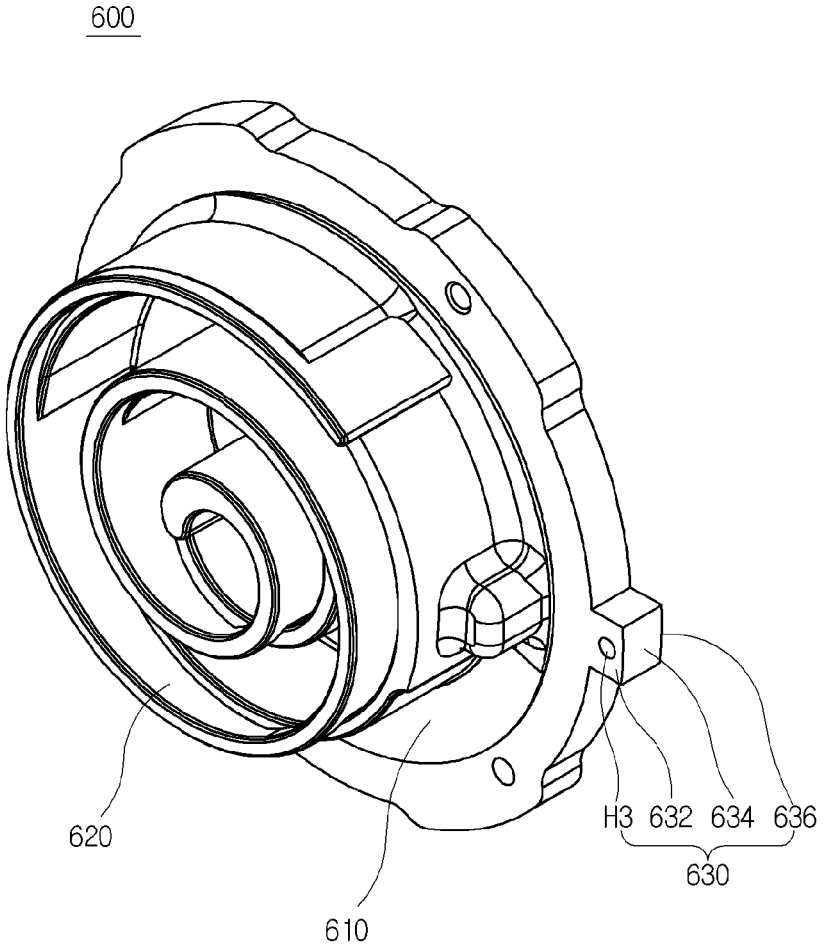
FIG. 10 is a perspective view showing a rear surface of FIG. 9.

FIG. 2 is a cross-sectional view showing a scroll compressor according to an embodiment of the present disclosure, FIG. 3 is an enlarged view of part A of FIG. 2, FIG. 4 is a cross-sectional view showing the scroll compressor of FIG. 2 in a different direction, FIG. 5 is an enlarged view of part B of FIG. 4, FIG. 6 is a perspective view showing a first casing in the scroll compressor of FIG. 2, FIG. 7 is a perspective view showing a main frame in the scroll compressor of FIG. 2, FIG. 8 is a perspective view showing a rear surface of FIG. 7, FIG. 9 is a perspective view showing a fixed scroll in the scroll compressor of FIG. 2, and FIG. 10 is a perspective view showing a rear surface of FIG. 9.

Referring to FIGS. 2 to 10, a scroll compressor according to an embodiment of the present disclosure may include a casing 100, a motor 200 for generating a rotational force inside the casing 100, a rotating shaft 300 rotated by the motor 200, an orbiting scroll 500 orbitingly moved by the rotating shaft 300, a fixed scroll 600 engaged with the orbiting scroll 500 to form a pair of compression chambers C, and a main frame 700 supporting the orbiting scroll 500.

The casing 100 may include a first casing 110 having an accommodation space S in which the motor 200, the rotating shaft 300, the orbiting scroll 500, the fixed scroll 600 and the main frame 700 are accommodated and a second casing 120 fastened to the first casing 110 and covering the accommodation space S.

The first casing 110 may include a first casing base plate 112 supporting one end of the rotating shaft 300 and a first casing side plate 114 protruding from an outer periphery of the first casing base plate 112 toward the second casing 120 and supporting the motor 200, the main frame 700 and the fixed scroll 600.

The first casing base plate 112 is formed in a substantially circular plate shape, may include a rotating shaft support groove formed on a central portion of the first casing base plate 112 and into which one end of the rotating shaft 300 is inserted.

The first casing side plate 114 is formed in a substantially annular shape, and may include a suction port (not illustrated) communicated with a refrigerant suction pipe (not illustrated) for guiding the refrigerant from an outside to the accommodation space S (more precisely, a first space S1 to be described later).

In addition, the first casing side plate 114 may include a first flange insertion groove 116 concavely formed from an end surface of the first casing side plate 114 and an inner circumferential surface of the first casing side plate 114 so that a main frame flange 730, which will be described later, is inserted therein, and a second flange insertion groove 118 concavely formed from the end surface of the first casing side plate 114 and the inner circumferential surface of the first casing side plate 114 so that a fixed scroll flange 630, which will be described later, is inserted therein.

The first flange insertion groove 116 may include a first flange insertion groove base surface 116*a* bent from the inner circumferential surface of the first casing side plate 114, and a first flange insertion groove inner circumferential surface 116*b* bent from the first flange insertion groove base surface 116*a* and extending to the end surface of the first casing side plate 114.

In addition, the first flange insertion groove 116 may include a second fastening hole H2 concavely formed from the first flange insertion groove base surface 116*a* so that a first fastening member 810, which will be described later, is inserted therein.

The second flange insertion groove 118 may include a second flange insertion groove base surface 118*a* bent from the inner circumferential surface of the first casing side plate 114, and a second flange insertion groove inner circumferential surface 118*b* bent from the second flange insertion groove base surface 118*a* and extending to the end surface of the first casing side plate 114.

In addition, the second flange insertion groove 118 may include a fourth fastening hole H4 concavely formed from the second flange insertion groove base surface 118*a* so that a second fastening member 820, which will be described later, is inserted therein.

In addition, the first flange insertion groove 116 may include a pin insertion groove G concavely formed from the first flange insertion groove base surface 116*a* so that a positioning pin P, which will be described later, is inserted therein.

The second casing 120 may include a second casing base plate 122 opposite to the fixed scroll 600, and a second casing side plate 124 protruding from an outer periphery of the second casing base plate 122 and fastened to the first casing side plate 114.

The second casing base plate 122 may include a discharge chamber D for receiving the refrigerant discharged from the compression chamber C.

In addition, the second casing base plate 122 may include a discharge port (not illustrated) communicating with a refrigerant discharge pipe (not illustrated) for guiding the refrigerant of the discharge chamber D to the outside.

An end surface of the second casing side plate 124 may be formed to face the end surface of the first casing side plate 114 and a fixed scroll flange upper surface 636, which will be described later, so that the second casing side plate 124 may be fastened to the first casing side plate 114 and that a fixed scroll flange 630, which will be described later, may be prevented from being separated from the second flange insertion groove 118. That is, an outer diameter of the second casing side plate 124 may be formed at the same level as an outer diameter of the first casing side plate 114, and an inner diameter of the second casing side plate 124 may be formed smaller than an inner diameter of the second flange insertion groove 118.

Here, the first casing 110 is integrally formed. However, as the main frame 700 is formed to be attached to and detached from the first casing 110, even when the first casing 110 is integrally formed, the motor 200, the rotating shaft 300, the orbiting scroll 500 and the fixed scroll 600 may be inserted from the second casing 120 toward the first casing 110 to be accommodated in the accommodation space S. That is, the motor 200 and the rotating shaft 300 may be inserted into the accommodation space S first. Then, as the main frame 700 is inserted into the accommodation space S, the accommodation space S may be divided into a first space S1 in which the motor 200 is accommodated, and a second space S2 in which the orbiting scroll 500 and the fixed scroll 600 are accommodated. Then, an eccentric bush 400 for rotating the orbiting scroll 500 is inserted into the accommodation space S (more precisely, the second space S2) and is fastened to the rotating shaft 300, and the orbiting scroll 500 may be inserted into the accommodation space S (more precisely, the second space S2) and fastened to the eccentric bush 400. Then, the fixed scroll 600 may be inserted into the accommodation space S (more precisely, the second space S2). Then, the second casing 120 may be coupled to the first casing 110 to cover the accommodation space S.

On the other hand, since leakage may occur between the end surface of the first casing side plate 114 and the end surface of the second casing side plate 124, in order to prevent this, a sealing member 900 for sealing the accommodation space S from the outside of the casing 100 may be formed between the end surface of the first casing side plate 114 and the end surface of the second casing side plate 124.

The motor 200 may include a stator fixed to the first casing side plate 114 and a rotor rotating inside the stator by interaction with the stator.

The rotating shaft 300 is fastened to the rotor and passes through a central portion of the rotor, one end of the rotating shaft 300 may pass through the main frame 700, and the other end of the rotating shaft 300 may be supported by the first casing base plate 112.

The orbiting scroll 500 may include an orbiting scroll base plate 510 formed in a disk shape, orbiting scroll wrap 520 protruding from a central portion of the orbiting scroll base plate 510 toward the fixed scroll 600, and an orbiting scroll boss 530 protruding from the central portion of the orbiting scroll base plate 510 to the opposite side of the orbiting scroll wrap 520 and fastened with the eccentric bush 400.

The fixed scroll 600 may include a fixed scroll base plate 610 formed in a disk shape, a fixed scroll wrap 620 protruding from a central portion of the fixed scroll base plate 610 and engaged with the orbiting scroll wrap 520, and a fixed scroll flange 630 projecting radially from an outer circumferential surface of the fixed scroll base plate 610 and inserted into the second flange insertion groove 118 of the first casing 110.

Here, the fixed scroll base plate 610, the fixed scroll wrap 620 and the fixed scroll flange 630 may form an exterior of the fixed scroll 600.

A discharge hole 612 for discharging the refrigerant of the compression chamber C to the discharge chamber D may be formed at the central portion of the fixed scroll base plate 610.

The fixed scroll flange 630 is for fastening the fixed scroll 600 to the first casing 110, and may be formed to be fastened to the first casing 110 while being inserted into the second flange insertion groove 118.

Specifically, the fixed scroll flange 630 may include a fixed scroll flange base surface 632 in contact with the second flange insertion groove base surface 118*a*, a fixed scroll flange outer circumferential surface 634 bent from the fixed scroll flange base surface 632 and opposed to the second flange insertion groove inner circumferential surface 118*b*, a fixed scroll flange upper surface 636 bent from the fixed scroll flange outer circumferential surface 634 and forming a rear surface of the fixed scroll flange base surface 632, and a third fastening hole H3 passing through the fixed scroll flange 630 from the fixed scroll flange upper surface 636 to the fixed scroll flange base surface 632.

Here, the fixed scroll flange 630 may be fastened to the first casing side plate 114 by a second fastening member 820 inserted into the third fastening hole H3 and the fourth fastening hole H4.

The main frame 700 may include a main frame base plate 710 provided on an opposite side of the fixed scroll base plate 610 with respect to the orbiting scroll 500, and a main frame flange 730 radially protruding from an outer circumferential surface of the main frame base plate 710, and inserted into the first flange insertion groove 116 of the first casing 110.

Here, the main frame base plate 710 and the main frame flange 730 may form an exterior of the main frame 700.

A shaft hole 712 and a back pressure chamber 714 may be formed in the main frame base plate 710, wherein one end of the rotating shaft 300 passes through the shaft hole, wherein the back pressure chamber provides a space in which the eccentric bush 400 coupled to one end of the rotating shaft 300 may be rotated, and wherein the back pressure chamber presses the orbiting scroll 500 to the fixed scroll 600.

In addition, a radial reinforcing rib 716 for improving the rigidity of the main frame base plate 710 may be formed on a motor-facing surface of the main frame base plate 710.

In addition, a suction hole 722 passing through the main frame base plate 710 to communicate the first space S1 and the second space S2 may be formed in an outer periphery of the main frame base plate 710, so that the refrigerant introduced into the first space S1 through the refrigerant suction pipe (not illustrated) is guided to the compression chamber C.

The main frame flange 730 is for fastening the main frame 700 to the first casing 110, and may be formed to be fastened to the first casing 110 while being inserted into the first flange insertion groove 116.

Specifically, the main frame flange 730 may include a main frame flange base surface 732 contacting the first flange insertion groove base surface 116*a*, a main frame flange outer circumferential surface 734 bent from the main frame flange base surface 732 and facing the first flange insertion groove inner circumferential surface 116*b*, a main frame flange upper surface 736 bent from the main frame flange outer circumferential surface 734 and forming a rear surface of the main frame flange base surface 732, and a first fastening hole H1 passing through the main frame flange 730 from the main frame flange upper surface 736 to the main frame flange base surface 732.

Here, the main frame flange 730 may be fastened to the first casing side plate 114 by a first fastening member 810 inserted into the first fastening hole H1 and the second fastening hole H2.

In addition, the main frame flange 730 may further include a positioning pin P inserted into the pin insertion groove G, so that the first fastening hole H1 and the second fastening hole H2 are aligned and that the main frame flange 730 is positioned at a predetermined position when the main frame flange inserted into the first flange insertion groove 116.

The positioning pin P may be integrally formed with the main frame flange 730 or may be formed to be attached to and detached from the main frame flange 730.

Hereinafter, operational effects of the scroll compressor according to the present embodiment will be described.

That is, when power is applied to the motor 200, the rotating shaft 300 may rotate together with the rotor.

And, the orbiting scroll 500 may be orbited by receiving rotational force from the rotating shaft 300 through the eccentric bush 400.

Accordingly, the volume of the compression chamber C may be reduced while continuously moving toward the central portion.

In addition, the refrigerant may be introduced into the second space S2 through the refrigerant suction pipe (not illustrated), the first space S1, and the suction hole 722.

And, the refrigerant introduced into the second space S2 may be sucked into the compression chamber C.

In addition, the refrigerant sucked into the compression chamber C may be compressed while moving toward the central portion along a movement path of the compression chamber C and discharged to the discharge chamber D through the discharge hole 612.

And, the refrigerant discharged to the discharge chamber D may be discharged to the outside of the compressor through the refrigerant discharge pipe (not illustrated).

Here, in the scroll compressor according to this embodiment, as the orbiting scroll 500 and the fixed scroll 600 are accommodated in the casing 100, noise generated in the compression chamber C may be reduced by the casing 100. Accordingly, the noise generated in the compression chamber C may be prevented from radiating to the outside of the casing 100.

In addition, as the fixed scroll base plate 610, the main frame base plate 710 and the first casing side plate 114 form the orbiting space of the orbiting scroll 500, and as the orbiting scroll 500 faces the first casing side plate 114 in a radial direction, that is, as the fixed scroll wrap 620 faces the casing 100, an orbiting radius of the orbiting scroll 500 may be increased. That is, the orbiting radius of the orbiting scroll 500 may be formed at a maximum within a range in which the orbiting scroll 500 does not interfere with the first casing side plate 114.

Thereby, the refrigerant discharge amount may be increased while an axial height of the compression chamber C is maintained at a predetermined level. That is, the refrigerant discharge amount may be increased while the rigidity of the orbiting scroll wrap 520 and the fixed scroll wrap 620 is maintained at a predetermined level.

Alternatively, the outer diameter of the first casing side plate 114 may be reduced while the refrigerant discharge amount is maintained at a predetermined level. Accordingly, the weight and cost of the scroll compressor may be reduced, and vehicle mountability may be improved.

On the other hand, in the fixed scroll 600, as the fixed scroll base plate 610 is not directly fastened to the first casing side plate 114 but is fastened to the first casing side plate 114 through the fixed scroll flange 630, the rigidity of the fixed scroll base plate 610 may be secured even if the thickness of the fixed scroll base plate 610 is formed thin. That is, the thickness of the fixed scroll base plate 610 may be reduced while the rigidity of the fixed scroll base plate 610 is maintained at a predetermined level, and in this case, the axial length, cost and weight of the scroll compressor are reduced, and vehicle mountability may be improved.

Similarly, in the main frame 700, as the main frame base plate 710 is not directly fastened to the first casing side plate 114 but is fastened to the first casing side plate 114 through the main frame flange 730, the rigidity of the main frame base plate 710 may be secured even if the thickness of the main frame base plate 710 is formed thin. That is, the thickness of the main frame base plate 710 may be reduced while the rigidity of the main frame base plate 710 is maintained at a predetermined level, and in this case, the axial length, cost and weight of the scroll compressor are reduced, and vehicle mountability may be improved.

Meanwhile, as the main frame 700 is formed to be attached to and detached from the casing 100, the first casing 110 may be integrally formed. Accordingly, since it is sufficient if the accommodation space S is sealed only by the sealing member 900 interposed between the first casing 110 and the second casing 120, the cost may be reduced and the risk of leakage may be significantly reduced.

The invention claimed is:

1. A scroll compressor comprising:

a casing;

a motor generating a rotational force inside the casing;

a rotating shaft rotated by the motor;

an orbiting scroll orbitingly moved by the rotating shaft;

a fixed scroll engaged with the orbiting scroll to form a pair of compression chambers; and a main frame supporting the orbiting scroll, wherein the fixed scroll includes a fixed scroll base plate and a fixed scroll wrap protruding from the fixed scroll base plate, wherein the main frame includes a main frame base plate provided on an opposite side of the fixed scroll base plate with respect to the orbiting scroll, and wherein the fixed scroll base plate, the main frame base plate and the casing form an orbiting space of the orbiting scroll, wherein the fixed scroll further comprises a fixed scroll flange radially protruding from an outer circumferential surface of the fixed scroll base plate and fastened to the casing, wherein the main frame further comprises a main frame flange radially protruding from an outer circumferential surface of the main frame base plate and fastened to the casing, and wherein the casing further comprises a first casing having an accommodation space in which the motor, the rotating shaft, the orbiting scroll, the fixed scroll and the main frame are accommodated; and a second casing fastened to the first casing and covering the accommodation space.

2. The scroll compressor of claim 1, wherein the fixed scroll wrap is opposite to the casing.

3. The scroll compressor of claim 1, wherein the first casing further comprises a first casing base plate supporting one end of the rotating shaft; and a first casing side plate protruding from an outer periphery of the first casing base plate toward the second casing and supporting the motor, the main frame and the fixed scroll.

4. The scroll compressor of claim 3, wherein the first casing side plate further comprises a first flange insertion groove into which the main frame flange is inserted; and a second flange insertion groove into which the fixed scroll flange is inserted.

5. The scroll compressor of claim 4, wherein the first flange insertion groove further comprises a first flange insertion groove base surface bent from an inner circumferential surface of the first casing side plate; and a first flange insertion groove inner circumferential surface bent from the first flange insertion groove base surface and extending to an end surface of the first casing side plate.

6. The scroll compressor of claim 5, wherein the main frame flange further comprises a main frame flange base surface in contact with the first flange insertion groove base surface; a main frame flange outer circumferential surface bent from the main frame flange base surface and opposite to the first flange insertion groove inner circumferential surface; and a main frame flange upper surface bent from the main frame flange outer circumferential surface and forming a rear surface of the main frame flange base surface.

7. The scroll compressor of claim 6, wherein the main frame flange further comprises a first fastening hole passing through the main frame flange from the main frame flange upper surface to the main frame flange base surface, wherein the first flange insertion groove includes a second fastening hole formed to be concave from the first flange insertion groove base surface, and wherein the main frame flange is fastened to the first casing side plate by a first fastening member inserted into the first fastening hole and the second fastening hole.

8. The scroll compressor of claim 4, wherein the second flange insertion groove further comprises a second flange insertion groove base surface bent from an inner circumferential surface of the first casing side plate; and a second flange insertion groove inner circumferential surface bent from the second flange insertion groove base surface and extending to an end surface of the first casing side plate.

9. The scroll compressor of claim 8, wherein the fixed scroll flange further comprises a fixed scroll flange base surface in contact with the second flange insertion groove base surface; a fixed scroll flange outer circumferential surface bent from the fixed scroll flange base surface and facing the second flange insertion groove inner circumferential surface; and a fixed scroll flange upper surface bent from the fixed scroll flange outer circumferential surface and forming a rear surface of the fixed scroll flange base surface.

10. The scroll compressor of claim 9, wherein the fixed scroll flange further comprises a third fastening hole penetrating the fixed scroll flange from the fixed scroll flange upper surface to the fixed scroll flange base surface, wherein the second flange insertion groove includes a fourth fastening hole formed to be concave from the second flange insertion groove base surface, and wherein the fixed scroll flange is fastened to the first casing side plate by a second fastening member inserted into the third fastening hole and the fourth fastening hole.

11. The scroll compressor of claim 4, wherein the motor, the rotating shaft, the orbiting scroll, the fixed scroll, and the main frame are inserted from the second casing toward the first casing and accommodated in the accommodation space.

12. The scroll compressor of claim 4, wherein a sealing member sealing the accommodation space from the outside of the casing is formed between the first casing and the second casing, and wherein the accommodation space is sealed only by the sealing member.

* * * * *